United States Patent [19]

Kobayashi

[11] 4,104,831

[45] Aug. 8, 1978

[54] AUTOMATIC CENTRIFUGAL BARREL FINISHING MACHINE

[75] Inventor: Hisamine Kobayashi, Nagoya, Japan

[73] Assignee: Kabushiki Kaisha Shikishima Tipton, Nagoya, Japan

[21] Appl. No.: 820,940

[22] Filed: Aug. 1, 1977

[51] Int. Cl.[2] ..... B24B 31/04

[52] U.S. Cl. ..... 51/164 A; 233/25; 366/276

[58] Field of Search ..... 366/219, 235, 276; 51/164; 233/25

[56] References Cited

U.S. PATENT DOCUMENTS

| | | | |
|---|---|---|---|
| 2,923,104 | 2/1960 | Olson | 51/164 |
| 3,855,740 | 12/1974 | Kobayashi | 51/164 |

*Primary Examiner*—Harold D. Whitehead

[57] ABSTRACT

Automatic centrifugal barrel finishing machine of the type which includes a turret turning on its central axis at a high speed and carrying a plurality of barrels open at top which rotate on their own axes and revolve around the turret central axis, comprising a plurality of barrel holders rotatably and revolvably mounted on the turret and each carried by a dual-rotary shaft structure which consists of an outer hollow shaft and an inner shaft equipped at one end with a chuck engageable with a barrel mounting shaft thereby mounting barrels in position to the barrel holders, and an indexing table carrying a plurality of barrels at different stations and rotating through predetermined indexing steps to place the barrels in position for mounting one barrel to the turret holder while placing other barrels in position for discharging the contents therefrom and charging new contents therein, the operations of the indexing table being operatively associated with the operation of the turret and performed in parallel with and during the operation of the turret.

19 Claims, 5 Drawing Figures

AUTOMATIC CENTRIFUGAL BARREL FINISHING MACHINE

BACKGROUND OF THE INVENTION

1. Field of the Invention

The present invention relates to improvement to and of the automatic centrifugal barrel finishing machine of the type which includes a turrent turning on its central axis at a high speed and carrying a plurality of barrels open at top for axial and orbital rotation, the improvement comprising a plurality of barrel holders rotatably and revolvably mounted to the turret and each having an upper stationary plate and a movable bottom plate for holding a barrel or barrels therebetween, the upper plate being carried by an inner shaft with a chuck and the bottom plate having a barrel mounting shaft to be engaged by the chuck, an indexing table which moves horizontally and vertically and rotates with predetermined indexing steps and sequence control means to control the above-mentioned operations in the predetermined sequence.

2. Description of the Prior Art

A conventional centrifugal barrel finishing machine operates at a high speed and with a high finishing efficiency, and is therefore known to have a wide range of use in the various industrial fields such as surface polishing, deburring, milling, stirring, mixing, chemical processing, etc. of workpieces together with abrasive or other media in the barrel containers. Disadvantages have been noted in accordance with the conventional machine, particularly with respect to the handling of top covers which are removably provided for covering and uncovering the barrels in operation, and the handling of workpieces and/or media for charging and discharging the same in the barrels, and in both cases the handling time requires a considerable length of time. The machine can itself complete its finishing or treating cycle in several minutes while the recharging interval of workpieces and/or media is relatively long, usually taking ten and several minutes, or several ten minutes when the number of barrels is increased.

In order to eliminate the above disadvantages, various solutions have been proposed. For example, the barrel holder mounted to the turret has a packing at the underside thereof, and the barrel is placed such that the open top edge of the barrel can be brought in intimate contact with the packing which can keep the barrel airtight or watertight only under pressure. In this case, the time required of handling the top covers is thus eliminated and the automatic handling of the barrels is thus permitted with the accompanying improved work efficiency. It is observed, however, that the barrel holding mechanism is not satisfactory so much so that it cannot hold the barrels securely, thus causing the barrels to slip out of the holding mechanism during the operation. On such event, the barrels may seriously damage the overall constructions of the machine.

SUMMARY OF THE INVENTION

In order to eliminate the disadvantages and problems cited above, it is a principal object of the present invention to provide improved automatic centrifugal barrel finishing machine of the type including a high speed turret carrying a plurality of barrels rotating on their own shafts and revolving about the turret central shaft, wherein a dualshaft structure consists of an outer hollow shaft and an inner shaft, the inner shaft having at one end thereof a chuck means for holding a shaft mounting the barrel to the bottom plate.

Another object of the present invention is to provide improved barrel finishing apparatus which eliminates the use of top covers of the type which covers the barrels open at top, and nevertheless permits the barrels to be mounted to the turret with airtightness and watertightness.

It is a further object of the present invention to provide improved barrel finishing apparatus which further includes an indexing table structure whose operations are associated with the operation of the turret for finishing or the like of workpieces and can also be performed simultaneously in parallel with and during the operation of the finishing machine, and which permits barrels to be placed in position or out of position on the turret without human intervention while barrels at other stations can have a feeding operation of controlled amounts of workpieces and media.

A still further object of the invention is to provide improved apparatus which includes an indexing table having a barrel reversible or turnover plate at a discharging position.

BRIEF DESCRIPTION OF DRAWINGS

Other advantages and features of the invention will become apparent from the succeeding description and appended claims by reference to the accompanying drawings, in which:

DESCRIPTION OF THE PREFERRED EMBODIMENTS

Figure 1:
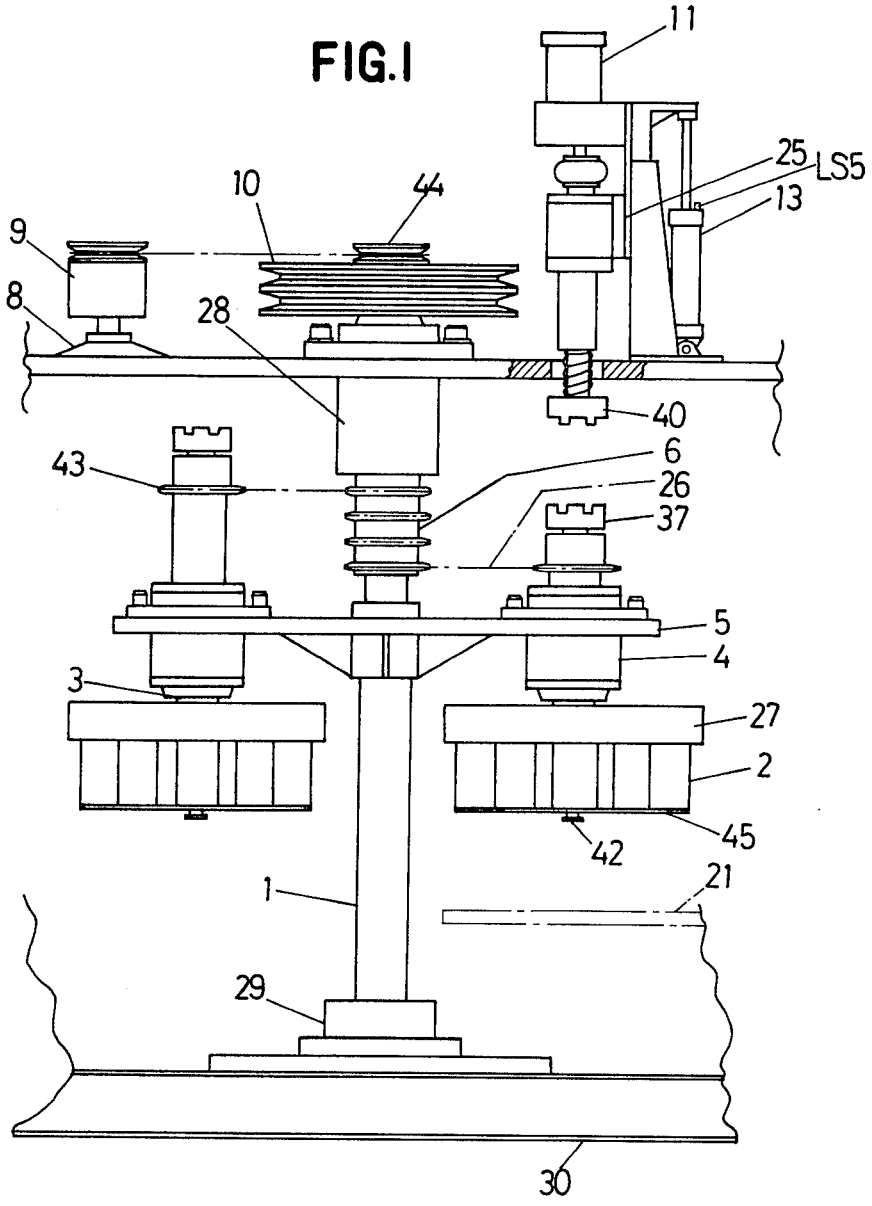
FIG. 1 is a front view of the automatic centrifugal barrel finishing apparatus for use with the present invention and incorporating the invention.
Figure 2:
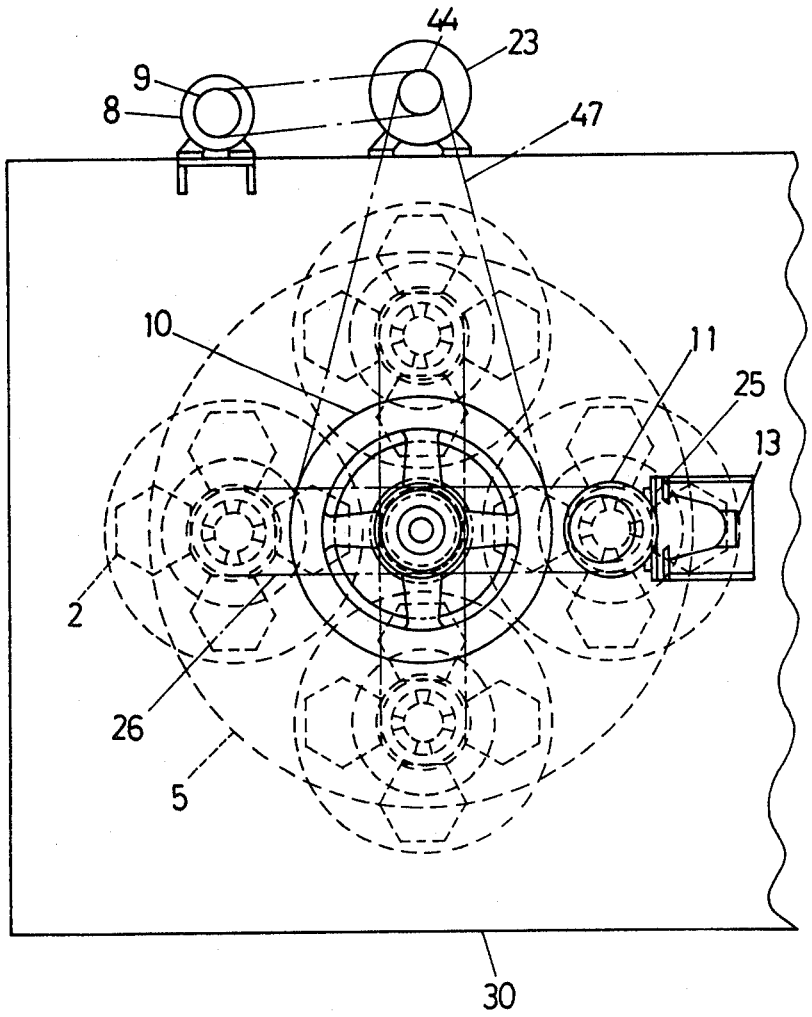
FIG. 2 is a plan view of FIG. 1.
Figure 3:
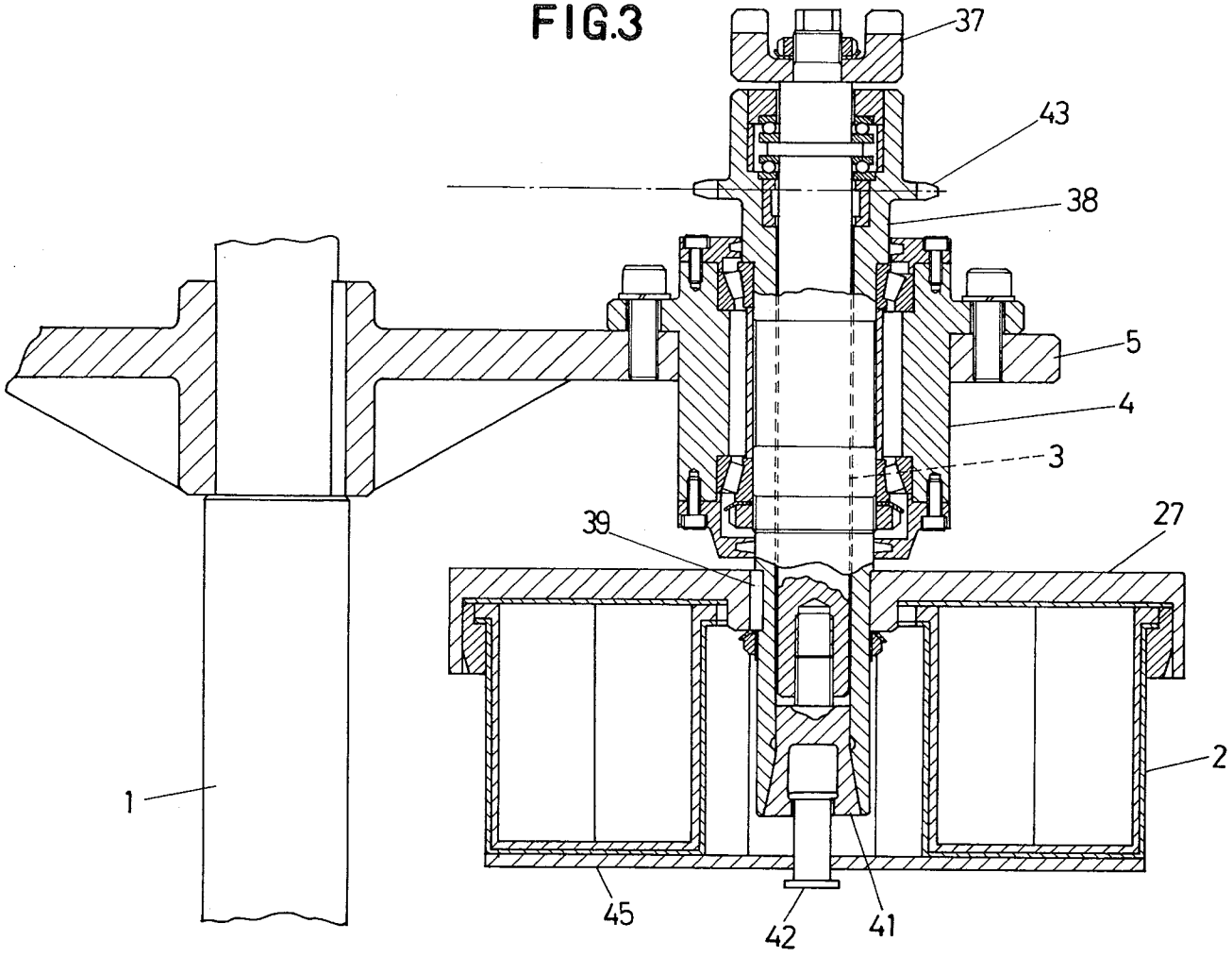
FIG. 3 is a partial enlarged sectional view showing details of the construction embodying the invention.

The present invention will further be illustrated by way of example only by reference to the accompanying drawings. Referring first to FIGS. 1 and 2, a housing is designated by 30 in which machine parts or element which are specifically to be described later have the functional and operational arrangement. In FIG. 1, a central shaft 1 is rotatably supported at both ends by bearings 28 and 29 secured to the housing 30 as shown. Secured to the upper end of the central shaft 1 is a pulley assembly which consists of a main pulley 10 and an inching pulley 44. The central shaft 1 also carries a turret 5 in its intermediate position, the turret 5 carrying a plurality of barrel shafts 3 for rotation. Four barrel shafts 3 are shown for an example, for convenience of illustration and simplicity of understanding, and it should be understood that their number is not limited to the example shown. Details of the barrel shaft 3 are shown in FIG. 3, in which a bearing 4 is rigidly secured to the turret 5 and an outer hollow shaft 38 is rotatably carried by the bearing 4. Rigidly secured to the lower end of the hollow shaft 38 is a barrel holder 27 which is fixed in position to the shaft 38 by means of a key or similar locking device designated by 39, and mounted to the upper end of the shaft 38 is a chain sprocket wheel 43. The aforementioned barrel shaft 3 fits and passes into the interior of the hollow shaft 38 rotatably. Rigidly fixed to the upper end of the barrel shaft 3 is a clutch assembly 37 which operates for clamping the barrel, and the lower end of the shaft 3 has an internally threaded opening with which a threaded bolt of a chuck assembly 41 engages. The chuck 41 has a holding aperture at the lower end and has the tapered form. Thus, the chuck assembly 41 fits inside the tapered aperture provided at the bottom end of the hollow shaft 38. The chuck assembly 41 may be provided with vertical splits as in the known similar device so that its holding aperture can diametrically be contracted when it engages with the tapered aperture of the hollow shaft 38. A barrel mounting shaft 42 is provided through a bottom plate 45 on which barrels 2 are placed, and at its upper end engages with the holding aperture of the chuck assembly 41. The upper bearing 28 of the central shaft 1 is equipped with chain sprocket wheel assembly 6 which has the driving connection with the chain sprocket wheel 43 by way of a chain 26. The barrel shaft 3 is thus driven for rotation by rotating the driving central shaft 1. The main pulley 10 is connected with a main electric motor 23 by way of a belt shown by broken lines, and is thereby driven for a high speed rotation. The inching pulley 44 is operatively associated with the rotary shaft of a turret positioning motor 8 by way of a cam clutch assembly 9. Rotation of the motor 8 can be imparted to the main pulley 10 while rotation of the main motor 23 is prevented from being imparted to the motor 8. A vertically moving sliding assembly 25 is provided on top of the housing 30, on which a motor 11 is provided for rotating a clutch 40 later to be described. The motor 11 is capable of a vertical movement which is effected by means of a fluidoperated cylinder 13 through the sliding assembly 25, and is specially designed and constructed so that it can rotate reciprocally within certain angles by introducing hydraulic pressure or pneumatic pressure in the two different directions. The motor 11 may also be an electric locking motor which is capable of changing its torque and locking. As noted, the motor 11 is known per se, and is preferably of the type of a high rotor manufactured by Kuroda Seiko Co., Ltd. The shaft of the motor extends downwardly through the housing 30 and has a clutch 40 at the lower end, the clutch 40 engaging a clutch 37 provided on the barrel shaft 3. The barrels (four barrels shown) are fixed in position on the bottom plate 45, and the bottom plate 45 carries the earlier-mentioned shaft 42 passing through the center of the plate 45. As previously described, the upper end of the shaft 42 is held by the chuck assembly 41. Either the underside of the barrel holder 27 or the upper face of a barrel 2, or both are covered at the edges thereof with rubber or synthetic resin material in order to maintain the barrel 2 airtight or watertight. Barrels are transported on a separate indexing table 21 which will later be described in details, and are thereby placed in position or out of position relative to the barrel holder 27. A fluid-operated cylinder not shown but to be described later in FIG. 5 is provided for stopping the turret 5 in position, and the piston rod of the cylinder engages with any one of apertures provided in the turret 5 when the above cylinder is actuated for having its piston rod projecting, thus bringing the turret 5 to a stop.

In accordance with the construction of the machine heretofore illustrated by reference to FIGS. 1 to 3, its operation is now described below. All operations performed by the machine may be sequence-controlled so that they can automatically proceed from one cycle to another without the intervention of an operator, but for better understanding of the construction and the functions thereof, the manual operation is described in which the machine requires an intervention by an operator who manually depresses an appropriate switch at the end of one cycle to proceed to a next cycle. Workpieces to be finished are placed in a barrel 2 together with a mass of abrasive or other treatment media which, if necessary, contain an amount of water. The barrel 2 is then placed on the laterdescribed indexing table 21 which travels to below the barrel holder 27 where the table 21 is stopped to place the barrel 2 in position below the corresponding holder 27. Then, the table 21 is operated to move up and thus to bring the open top of the barrel 2 in intimate contact with the underside of the barrel holder 27 while the shaft 42 through the bottom plate 45 engages the chuck 41. The above operation of the indexing table 21 may be carried out automatically, but may also be performed manually if small-size barrels are employed. Next, the fluid-operated cylinder 13 is operated while the sliding assembly 25 is operated therewith for sliding downwardly so that the motor assembly 11 can also be moved down, thus engaging the two clutches 40 and 37 one with another. With the clutches 40 and 37 engaged, the motor 11 is energized for rotation through a predetermined angle, which causes the engaged clutches 40 and 37 to rotate through the same angle, thus making the threaded end of the chuck 41 engage with the internally threaded end of the barrel shaft 3 while making the shaft 42 securely held by the chuck 41. In this way, the barrel 2 is held in position by the barrel holder 27. The motor assembly 11 is again moved up by the fluid-operated cylinder 13 through the sliding assembly 25 so that the clutch 40 is moved therewith away from the clutch 37, and a pressurized fluid is then introduced into the piston rod side of the fluid-operated cylinder not shown in FIGS. 1 to 3 but later to be described, thus moving the piston rod away from the aperture not shown of the turret 5 opposite the rod, which is thereby disengaged. The motor 8 is then energized for driving the turret 5 with inching rotary motion until the turret 5 is placed in a predetermined position while the above fluid-operated cylinder not shown is again operated for having its piston rod projecting out of the cylinder. When the piston rod is brought in engagement with one of the apertures of the turret 5 adjacent to the earlier mentioned aperture, the motor 8 is then stopped. At this moment, a next barrel is placed to be held by the barrel holder 27 in the aforementioned manner. As mentioned in the foregoing description, the machine shown in FIGS. 1 to 3 employs four barrels, and the operations described above are repeated with respect to the other barrels until all barrels are finally placed to be held in position by the corresponding barrel holder 27. With all barrels held by the holder, the main motor 23 is powered on, causing the turret 5 to rotate on its central axis 1 by way of a belt or chain 47 while causing the barrels both to rotate with the turret 5 and to rotate on their respective shafts by means of the broken-line shown chain belt which mesh with the chain sprockets wheels 6 and 43. In this manner, the workpieces in the barrels are subjected to the various treatments such as polishing or finishing, milling or crashing, stirring, mixing, chemical processing and other similar treatments. At the end of a predetermined period of time during which any of the above treatments has been carried out, a timer not shown is actuated for stopping the main motor 23 while the turret stopping fluid-operated cylinder not shown is operated for having it piston rod projecting. The turret positioning motor 8 is also energized for causing the turret 5 to rotate by inches. Thus, when the projecting piston rod of the above cylinder engages one of the aperatures of the turret 5, the motor 8 is stopped. Then, the fluid-operated cylinder 13 is operated for moving the motor 11 downwardly with the sliding assembly 25, thereby engaging the clutch 40 with the clutch 37. With the clutches engaged, the motor 11 is then rotated reversely through a predetermined angle, it being noted that the rotation of the motor 11 in this case is effected in a different direction from that at the start. Then, the shaft 42 is released from the chuck 41 whose holding power is decreased by reopening of it caused by withdrawal of the barrel shaft 3, thereby making the barrel free from the barrel holder 27. The barrel is then moved away on the indexing table 21 or by hand. The above operations are repeated with respect to each of all other barrels. Outside the machine, already finished workpieces in the barrels are removed from the barrels, into which workpieces next to be finished are instead placed for having the same treatment as is carried out in accordance with the operations described heretobefore.

Figure 4:
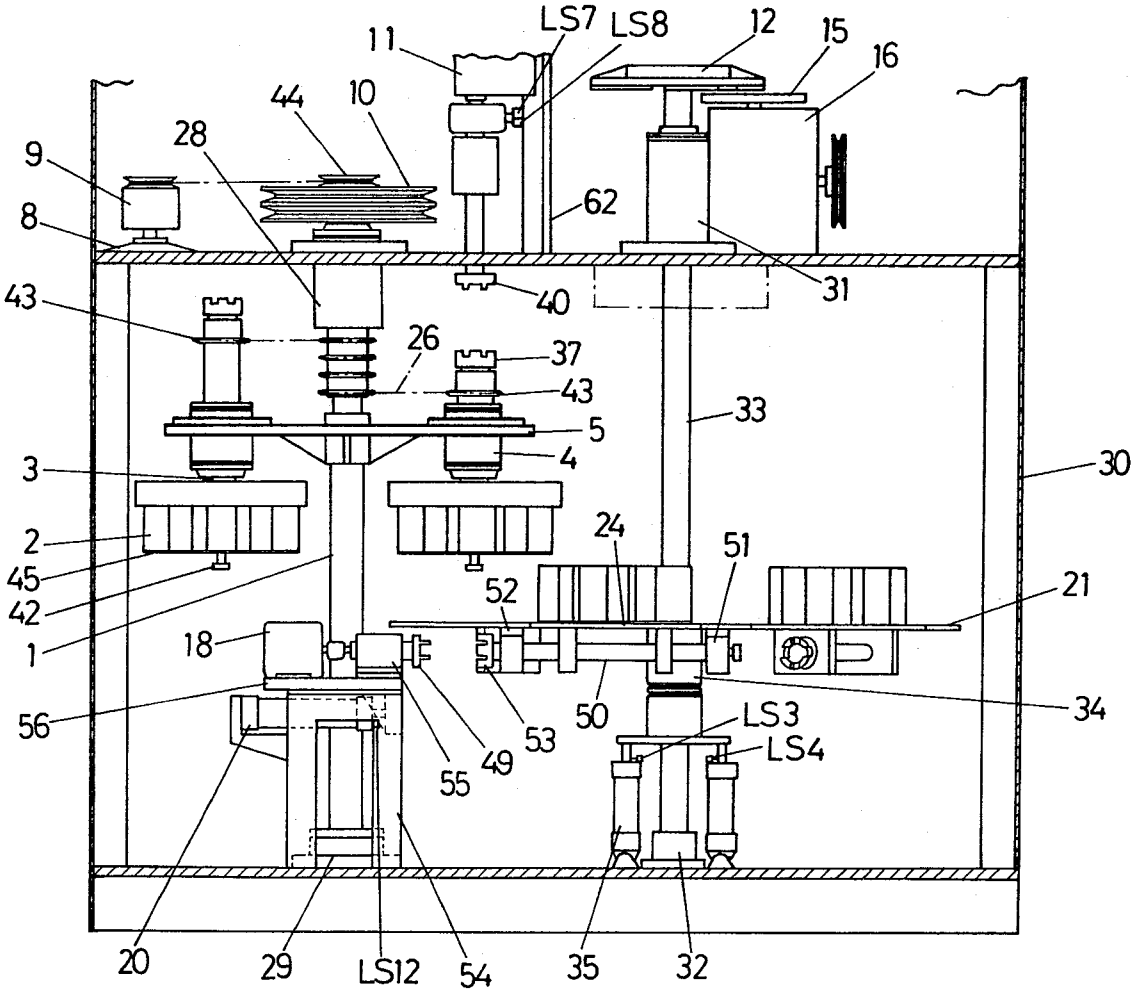
FIG. 4 is a front view of another preferred embodiment of the invention.
Figure 5:
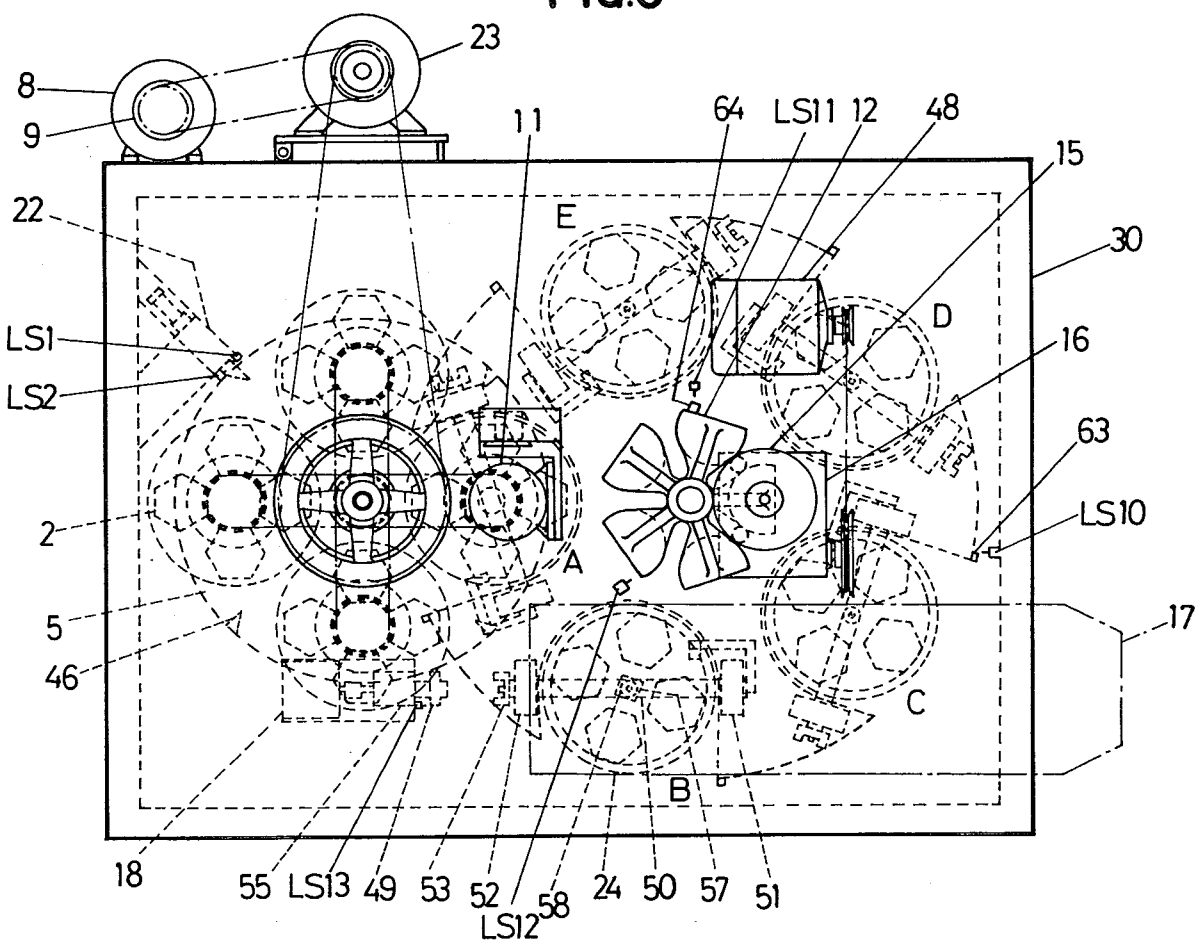
FIG. 5 is a plan view of FIG. 4.

Referring next to FIGS. 4 and 5, another preferred embodiment of the invention is illustrated below. Generally, and fundamentally, the machine in FIGS. 4 and 5 has a similar construction to that in FIGS. 1 to 3, and reference should therefore be made to the first embodiment for details of the construction of the machine. Thus corresponding parts or elements have same reference numerals in FIGS. 4 and 5 for simplicity and ease of understanding while additional parts or elements are given new reference numerals.

As particularly shown in FIG. 4, an indexing apparatus is provided within the housing 30, for placing barrels 2 in position or out of position on the finishing machine. The apparatus includes a central vertical shaft 33 carrying the indexing table 21, the shaft 33 extending in parallel with the turret central shaft 1 and having both ends thereof rotatably supported by corresponding upper and lower bearings 31 and 32 rigidly secured to the housing 30. The indexing table 21 fits or is carried by the shaft 33 therethrough slidably up and down but not rotatably along the length of the shaft 33. The rotation of the indexing table 21 is prevented by splining or slidable keying means. Secured to the underside of the indexing table 33 is a support plate 34 which forms a part of the table 21. Below the support plate 34 is mounted a fluid-operated cylinder assembly generally designated by 35 which consists of a plurality of vertical cylinders. As shown in FIG. 4, the piston rods of the cylinders 35 are always in contact with underside of the support plate 34 so that the support plate 34 and accordingly the indexing table 21 can be moved up and down as the piston rods protrude and retract, thereby permitting the cylinders to control the position of the table 21 along the length of the shaft 33. Above the shaft 33 is mounted an indexing drive assembly which indexes the shaft 33 for intermittent or stepwise rotation through intervals of regular angles and consists of a geneva gear 12 fixed to the shaft 33, a drive motor 48 mounted on top of the casing 30, a reduction gear 16 connected to the drive motor 48, and a geneva rotor 15 connected to the output shaft of the reduction gear 16. The geneva gear 12 has a plurality of teeth whose number corresponds to that of the indexing steps *n* as desired. In the example shown, five indexing steps *n* are given for convenience of illustration. The geneva gear 12 mesh with the geneva rotor 15 in such a manner that the recesses of the former are engaged by the projections of the geneva rotor 15. Thus, rotation of the geneva rotor 15 causes the geneva gear 12 to rotate therewith through an angle which is determined by the number of the teeth of the gear 12, such as an angle of 72° obtained by dividing an angle of 360° by the number of five teeth if the gear 12 has five teeth as shown. As described in the earlier embodiment, the barrel 2 has the bottom plate 45 fixed to the bottom thereof. The indexing table 21 also has the same number of reversible or turnover plates 24 as the indexing steps *n* on which the barrel 2 including the bottom plate 45 is placed. More specifically, below the indexing table 21 are provided horizontal shafts 50 which support the corresponding reversible plates 24, each of the shafts 50 having both ends thereof rotatably carried by corresponding bearings 51 and 52. The shaft 50 has a clutch 53 at one end thereof. A pedestal 54 is rigidly mounted to the bottom of the housing 30 in a position opposite the clutch 53 of the shaft 50, on which a sliding block 56 is slidably provided, the sliding block 56 carrying thereon a rotary cylinder 18 and a bearing 55 through which the piston rod of the cylinder 18 travels with the sliding block. The piston rod of the cylinder 18 has a clutch 49 at the end opposite the clutch 53, the clutch 49 being engageable with the clutch 53. The reversible plate 24 has a central aperture or bore therethrough for receiving the shaft 42 of the bottom plate 45 therethrough. The reversible plate 24 has two opposite slidable holding plates 57 and 58 for holding the shaft 42 therebetween and which are normally urged by springs not shown into being brought closer to each other. In other words, the shaft 42 of the bottom plate 45 is normally held by the two holding plates 57 and 58, and is thus immovably placed relative to the reversible plate 24. In a clamp releasing station located immediately below the barrel, designated by A in FIG. 5, a clamp release cylinder not shown rigidly fixed to the housing 30 is operated for having its piston rod projecting which compresses the not shown springs to force the holding plates 57 and 58 to be moved away from each other, thus disengaging the shaft 42 from the reversible plate 24. As readily understood from the foregoing description, a barrel 2 stops *n*-times or at *n* stations during the rotation through 360° which correspond to the indexing stops of the indexing table 21, the stations being designated by A, B, C, D, E as shown in FIG. 5. The following different operations are performed at the different stations. At the station A, a barrel is placed in position on or removed from the finishing machine, at the station B, the barrel having a mixture of already finished workpieces and media therein is reversed or turned over for discharging the same into a separating apparatus 17 which separates the mixture into workpieces and media, and at the stations C, D, E, a new charge of workpieces to be finished are again placed in the barrel, and controlled amounts of media and compounds are added in the barrel (this operation is performed by an independent feeding apparatus). Those stations C, D, E may be reserved for other uses. Where the finishing operation is completed within a very short period of time, there may be provided an annular separator and an annular feeding apparatus so that the waiting interval of time between the two succeeding finishing cycles of the machine can be minimized. In this way, it is possible almost simultaneously to discharge and recharge contents of all barrels which have been moved away from the machine, but a relatively large working area is required though the reduced waiting interval may be realized.

In accordance with the construction of the apparatus described by reference to FIGS. 4 and 5, its operations and functions are described below. As in the earlier embodiment of FIGS. 1 to 3, all operations are carried out automatically or without any human intervention, but some of the operations may be performed manually, such as by manual switching. All operations may also be sequentially controlled, and there are various sequence control systems available for this purpose. For ease of understanding the invention and for convenience of simplicity, a sequence control system is shown, for example, which includes timers, limit switches, etc. which are actuated at the end of each of the operations to provide output signals which actuate relays and electromagnetic valves for enabling the operations to proceed to succeeding operations. All barrels 2 having a charge of workpieces to be finished and an amount of media are placed in their respective stations A, B, C, D and E, the operation of which is herein referred to as "initial operation", and in this initial operation, the indexing table 21 is placed in its lower position while a barrel at the station A is placed in position on the turret 5. For the finishing operation, the main motor 23 is energized to rotate with a high speed. After an elapse of a preset or predetermined period of time, a timer is then actuated to stop the main motor 23, causing the fluid-operated cylinder 22 for stopping the turret 5 in position to be operated by having a pressurized fluid introduced into its piston side. Projection of the piston rod causes its tip to come in contact with the periphery of the turret 5, and simultaneously the motor 8 is energized for rotating the shaft 1 of the turret 5 with inching movement. While the turret 5 is thus rotating, the tip of the piston rod in contact with the turret 5 engages with one of the apertures 46 on the periphery of the turret 5. This engagement is sensed by a limit switch $LS_1$ (this symbol LS represents a limit switch and the designation of only $LS_x$ is shown hereinafter) provided at the open end of the cylinder 22, $LS_1$ delivering output signals which actuate a not shown relay for stopping the motor 8. As the motor 8 is thus stopped, one of the barrels 2 is placed immediately above the station A of the indexing table 21. As readily understood from the above, the aforementioned aperture of the turret 5 should be so positioned as to permit said one barrel to be stopped at the station A. The output signals of $LS_3$ actuate not shown relays and electromagnetic valves for introducing a pressurized fluid into the piston side of the fluid-operated cylinder assembly 35, thereby moving the indexing table 21 to its raised position. It should be noted that when the indexing table 21 is traveling up, the clamp releasing cylinder not shown has its piston rod projecting and the holding plates 57 and 58 are moved away. This movement of the indexing table 21 is sensed by $LS_3$ at the open end of the cylinder 35, and the output signals of $LS_3$ actuate not shown relays and electromagnetic valves for introducing a pressurized fluid into the piston side of the cylinder 13 supporting the motor 11, and the motor 11 is thus moved down for engaging the clutch 40 with the clutch 37. This engagement is sensed by $LS_5$ at the open end of the above cylinder 13, $LS_5$ delivering output signals which operate the motor 11 for rotation through a predetermined angle. The barrel shaft 3 is then rotated through the same angular distance while the chuck 41 is also rotated therewith and its holding power is thereby removed for releasing the shaft 3 therefrom. This completed releasing operation is sensed by $LS_7$ secured to the support 62 on which the motor 11 is mounted, the output signals of which cause the piston rod of the clamp release cylinder not shown to be retracted, thus moving the holding plates 57 and 58 closer to each other for holding the shaft 42 of the barrel 2. This holding operation is sensed by $LS_9$ not shown provided internally of one of the holding plates and which is depressed by the shaft 42, $LS_9$ delivering output signals which cause a pressurized fluid to be withdrawn from the piston side of the fluid-operated cylinder 35 while causing a pressurized fluid to be introduced into the piston rod side of the cylinder 35. This operation of the cylinder 35 can move the indexing table 21 to its lower position. At the lower position of the indexing table 21, the barrel which has the workpieces already finished is now picked up by the table 21 away from the turret 5. When the table 21 has moved to its lower position, it is sensed by $LS_4$ at the open end of the cylinder 35, $LS_4$ delivering output signals which actuate the geneva gear 12 to rotate by $1/n$. This rotation is detacted by depressing $LS_{10}$ on the casing 30 by a dog 63 on the opposite side of the indexing table 21. The output signals of $LS_{10}$ actuate the indexing table 21 again to move its raised position, and the output signals of $LS_3$ actuate the motor 11 to rotate toward tightening the clutches 40 and 37 together while causing the piston rod of the not shown clamp release cylinder to project, thus releasing the shaft 42 from the holding plates 57 and 58. In this way, the barrel containing workpieces now to be finished and media is placed in position on the machine. This release of the shaft 42 is sensed by $LS_9$ which provides output signals which permit the following operations to be performed, i.e., moving the motor 11 up to its raised position (which is sensed by $LS_6$), moving the indexing table 21 to its lower position (sensed by $LS_3$) and retracting the piston rod of the cylinder (sensed by $LS_2$). As the above operations are complete and the output signals of the three switches $LS_6$, $LS_3$ AND $LS_2$ are received, the motor 8 is energized for rotation while the cylinder 22 is operated to have its piston rod projecting forward. Thereafter, the operations described earlier are performed so that a next barrel is placed above the station A. During rotation of the turret 5 the indexing table 21 is indexed with a rotation of $1/n$, bringing the barrels at the stations A, B, C, D and E to the respective succeeding stations B, C, D, E and A. At the new stations, one barrel containing already finished workpieces is removed from the turret 5 onto the indexing table 21 and a succeeding barrel containing unfinished workpieces is instead placed in position on the turret 5. Thereafter, the operations already described are performed. All other succeeding barrels at stations B, C, D and E are thus placed in their respective positions on the turret 5 one after another while the barrels containing already finished workpieces are instead removed from the turret 5 to the stations A, B, C and D of the indexing table 21. Then, the main motor 23 is energized for rotation, causing the turret 5 to rotate on its shaft 1 and thus causing the barrels to revolve about the shaft 1 with the turret 5 and also to rotate on their own shafts 3 which are driven by the chain sprocket wheels 6 and 43. During the axial and orbital rotations of the barrels, the workpieces in the barrels are subjected to any of the treatments such as finishing, milling, stirring, mixing, chemical processing and the like, while the barrels containing already treated workpieces, which are placed on the indexing table 21 outside the machine, have their contents removed therefrom and then have new charges of workpieces to be treated filled therein. The output signals from a not shown timer which actuates the main motor 23 also actuate the indexing table 21 to rotate by $3/n$. At this new position of the table 21, barrels are placed at stations B, A, E and D, and this position is sensed by $LS_{11}$ on the casing 30 which is depressed by a dog 64 on one side of the geneva gear 12, $LS_{11}$ providing output signals which cause a pressurized fluid to be introduced into the piston side of the fluid-operated cylinder 20 which is used for reversing barrels while causing the slide 56 on the pedestal 54 to move the rotary cylinder 18 forward and thus to engage the clutch 49 with the clutch 53. This engagement is sensed by $LS_{12}$ at the open end of the cylinder 20, $LS_{12}$ delivering output signals which cause a pressurized fluid to be introduced into the cylinder 18 which is thereby rotated through a predetermined angle. This rotation of the cylinder 18 causes the reversible plate 24 to turn on the shaft 50 through the engaged clutches 49 and 53, and the barrel on the plate 24 is then turned over so that the contents of the barrel are thrown out from the barrel into the separating apparatus 17 below the barrel. The separating apparatus is provided independently of the machine of the invention, and may be of a known vibratory sieving separator or magnetic separator. The separating apparatus is used for separating the discharged contents into workpieces and media, the workpieces being transported to an area outside the machine while the media, if reusable, being transported by conveying means to an upper media containing tank not shown. The period of time during which the barrel reversing operation is carried out is controlled by a not shown timer which, at the end of the discharge operation, supplies signals which cause a pressurized fluid to be introduced into the cylinder 18 so that the cylinder 18 can be rotated reversely and the barrel on the plate 24 is again placed upright. This upright position of the barrel is sensed by bringing a dog on the rear side of the clutch 49 in contact with $LS_{13}$ at the front end of the bearing 55, $LS_{13}$ producing output signals which cause a pressurized fluid to be introduced into the piston rod side of the cylinder 20 for retracting the clutch 49. The withdrawal of the clutch 49 is sensed by $LS_{12}$, the output signals of which actuate the geneva gear 12 for rotation by $1/n$, and the aforementioned operations are then repeated for discharging contents from the succeeding barrel. During those operations, a barrel at station C has a feeding of part of its charge from the independent feeding apparatus not shown. Therefore, the same operations are repeated with respect to other succeeding barrels, and barrels at stations D and E have the corresponding partial feeding of their contents from the feeding apparatus; when all barrels have a complete charge of the contents therein, they are placed at their respective stations B, C, D and E and thus the operations of the indexing table 21 are now complete. This is sensed by $LS_{12}$ which is depressed by the dog 64, and this point corresponds to the initial operation referred to earlier. All the operations which have been described heretobefore start at this point again to proceed in the described manner.

In accordance with the preferred embodiments shown and described of the apparatus of the invention, there is provided a vertical turret shaft which makes a turret capable of axial and orbital rotations with a very high speed, the turret having a plurality of barrel holders each rotatably carried by a dual-shaft structure consisting of an outer hollow shaft and an inner shaft equipped at one end with chucking means which is capable of holding the shaft fixed to the bottom plate on which barrels are placed so that the barrels open at top are brought in close contact with the underside of the barrel holder. As readily understood from the above, the barrels are open at top and yet are constructed without top covers which keep the barrels airtight or watertight, and therefore eliminate the necessity of handling the top covers individually by hand. The barrels can thus be placed in position or out of position on the machine with great easiness and accuracy. The indexing table for carrying barrels thereon is provided for vertical and rotary movement which is operatively associated with the operations of the machine, and includes the reversible plates on which the barrels are securely placed, for turning the barrels over from which their contents are automatically discharged. Furthermore, the indexing table permits an automatic feeding of controlled amounts of workpieces yet to be treated and of media into barrels at different stations. As those operations of the indexing table are performed in parallel with and during the operations of the finishing machine, there are advantages from the aspects of saving human labor and of improving all operations.

Although the invention has been illustrated by referring to the several preferred embodiment thereof, it should be understood that various changes and modifications may be made without departing from the spirit and scope of the invention.

What is claimed is:

1. An automatic centrifugal barrel finishing machine of the type including a turret capable of rotating on its vertical central shaft with a high speed and carrying a plurality of barrels open at top containing therein workpieces to be treated and treating media for treatments such as surface finishing, milling, deburring, stirring, chemical processing and the like, wherein the improvement comprises:

a housing;

a plurality of barrel holding plates connected to the turret rotatably and revolvably relative to the turret shaft, for holding the barrels tightly thereunder to keep the same airtight or watertight;

dual rotary shaft structure carrying said barrel holding plates therethrough, said structure comprising an outer hollow shaft for driven connection with said turret central shaft and an inner shaft having chuck means at a lower end thereof;

barrel supporting bottom plate for carrying barrels thereon, having a central barrel mounting shaft therethrough disengageably to be held by said chuck means; and a pair of clutch means including a first clutch connected to the other upper end of said inner shaft and a fluid-operated second clutch for engaging with said first clutch.

2. The machine as defined in claim 1, wherein said inner shaft of said dual rotary shaft structure has an internally threaded tapered lower end, and said chuck means has an outer tapered end for engaging with said tapered lower end of said inner shaft, and an aperture to be entered by said barrel mounting shaft of said bottom plate.

3. The machine as defined in claim 1, wherein said fluid-operated second clutch includes a fluid-operated cylinder, a sliding block operated by said cylinder for sliding vertical movement, a clutch rotating motor on said sliding block for sliding movement with said sliding block and for rotating reciprocally within predetermined angles, said motor having a shaft extending through said sliding block to be connected with said second clutch whereby vertical movement of said motor permits engagement and disengagement of said second clutch and said first clutch and rotation of said engaged second and first clutches through said predetermined angles.

4. The machine as defined in claim 3, wherein said clutch rotating motor is a hydraulic-operated motor.

5. The machine as defined in claim 3, wherein said clutch rotating motor is a pneumatic-operated motor.

6. The machine as defined in claim 3, wherein said clutch rotating motor is an electric locking motor.

7. An automatic centrifugal barrel finishing machine of the type including a turret capable of rotating on its vertical central shaft with a high speed and carrying a plurality of barrels open at top containing therein workpieces to be treated and treating media for treatments such as surface finishing, milling, deburring, stirring, chemical processing and the like, wherein the improvement comprises:

a housing;

a plurality of barrel holding plates connected to the turret rotatably and revolvably relative to the turret shaft, for holding the barrels tightly thereunder to keep the same airtight or watertight;

dual rotary shaft structure carrying said barrel holding plates therethrough, said structure comprising an outer hollow shaft for driven connection with said turret central shaft and an inner shaft having chuck means at a lower end thereof;

barrel supporting bottom plate for carrying barrels thereon, having a central barrel mounting shaft therethrough disengageably to be held by said chuck means;

a pair of clutch means including a first clutch connected to the other upper end of said inner shaft and a fluid-operated second clutch for engaging with said first clutch; and indexing means operable for vertical and rotary movement, comprising a vertical rotary shaft in parallel with said turret central shaft, indexing motion supply means connected to the upper end of said vertical rotary shaft for causing said rotary shaft to rotate with indexing stops through an angle of 360°, indexing table mounted to said rotary shaft at the mid-position thereof for vertical movement along the length of said rotary shaft and for indexed movement with said rotary shaft, barrel reversible means mounted to said indexing table for reversing the barrels for discharging the contents thereof, and fluid-operated cylinder means operated for moving said indexing table in vertical directions.

8. The machine as defined in claim 7, wherein said inner shaft of said dual rotary shaft structure has an internally threaded tapered lower end, and said chuck means has an outer tapered end for engaging with said tapered lower end of said inner shaft and an aperture to be entered by said barrel mounting shaft of said bottom plate.

9. The machine as defined in claim 7, wherein said fluid-operated second clutch includes a fluid-operated cylinder, a sliding block operated by said cylinder for sliding vertical movement, a clutch rotating motor on said sliding block for sliding movement with said sliding block and for rotating reciprocally within predetermined angles, said motor having a shaft extending through said sliding block to be connected with said second clutch whereby vertical movement of said motor permits engagement and disengagement of said second and first clutches and rotation of said engaged second and first clutch through said predetermined angles.

10. The machine as defined in claim 9 wherein said clutch rotating motor is a hydraulic-operated motor.

11. The machine as defined in claim 9, wherein said clutch rotating motor is a pneumatic-operated motor.

12. The machine as defined in claim 9, wherein said clutch rotating motor is an electric locking motor.

13. The machine as defined in claim 7, wherein said indexing motion supply means includes a driving motor on top of said housing, reduction gear means connected to said driving motor, geneva rotor means connected to the output of said reduction gear means and geneva gear means engaging said geneva rotor and secured to the upper end of said vertical rotary shaft of said indexing means.

14. The machine as defined in claim 7, wherein said barrel reversible means comprises a reversible plate for carrying a barrel thereon having a central aperture therethrough for being entered by said barrel mounting shaft of said bottom plate and shaft holding means for tightly holding said barrel mounting shaft, and fluid-operated barrel reversing means.

15. The machine as defined in claim 14, wherein said shaft holding means comprises a pair of spring-loaded holding plates.

16. The machine as defined in claim 14, wherein said fluid-operated barrel reversing means comprises a horizontal shaft rotatably supported below said reversible plate, having at one end thereof a first clutch means, and reversing power supply means aligned with said horizontal shaft, said reversing power supply means including a pedestal rigidly mounted on said housing, a sliding block on said pedestal for horizontal reciprocating movement, a fluid-operated rotary cylinder rigidly mounted on said sliding block, said rotary cylinder having a second clutch at the end thereof opposite said first clutch for engaging with said first clutch and causing said engaged second and first clutches to rotate reciprocally within predetermined angles, and a fluid-operated cylinder below said sliding block for moving said sliding block for horizontal reciprocation.

17. The machine as defined in claim 7, wherein said central turrent has a plurality of regularly spaced apertures on the periphery thereof, and a fluid-operated cylinder rigidly mounted to said housing for engaging said apertures of said turret.

18. The machine as defined in claim 7, wherein a series of all operations are sequence-controlled and automatically proceed at the end of one cycle of said series of operations to succeeding cycles.

19. The machine as defined in claim 7, wherein a series of all operations are sequence-controlled, and manually proceed at the end of one cycle of said series of operations to succeeding cycles.

* * * * *